US006688907B2

(12) United States Patent
Yamaoka et al.

(10) Patent No.: US 6,688,907 B2
(45) Date of Patent: Feb. 10, 2004

(54) CONNECTOR AND A CONNECTOR ASSEMBLY

(75) Inventors: Atsushi Yamaoka, Yokkaichi (JP); Yukinori Saka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/376,075

(22) Filed: Feb. 27, 2003

(65) Prior Publication Data

US 2003/0166358 A1 Sep. 4, 2003

(30) Foreign Application Priority Data

Mar. 1, 2002 (JP) ..... 2002-055378

(51) Int. Cl.[7] ..... H01R 3/00

(52) U.S. Cl. ..... 439/489; 439/188; 439/357; 439/352

(58) Field of Search ..... 439/489, 188, 439/352, 353, 372, 358, 357

(56) References Cited

U.S. PATENT DOCUMENTS 4,946,404 A * 8/1990 Takenouchi et al. ..... 439/352
5,827,086 A * 10/1998 Fukuda ..... 439/357
6,059,597 A * 5/2000 Endo et al. ..... 439/352
6,224,414 B1 * 5/2001 Fukuda ..... 439/352
6,241,542 B1 6/2001 Nishide et al.
6,254,418 B1 * 7/2001 Tharp et al. ..... 439/352
6,315,585 B1 * 11/2001 Oka ..... 439/157
6,361,334 B1 * 3/2002 Konoya et al. ..... 439/144
6,450,830 B1 * 9/2002 Koseki ..... 439/352

* cited by examiner

*Primary Examiner*—Gary Paumen
*Assistant Examiner*—Edwin A. León
(74) *Attorney, Agent, or Firm*—Gerald E. Hespos; Anthony J. Casella

(57) ABSTRACT

A connector has first and second housings (10, 20). The second housing (20) has a deformable lock arm (27) that engages the first housing (10) when the housings (10, 20) are connected. A slider (41) is mounted on the first housing (10) for movement between a position that prevents deformation of the lock arm (27) and a position that permits such deformation. Springs (40) bias the slider (41) to the deformation preventing position. The slider (41) has a resilient piece (60) that is pushed by the first housing (10) to move the slider (41) to the deformation permitting position as the housings (10, 20) are connected. The resilient piece (60) is deformed when the housings (10, 20) are connected and the slider (41) is propelled by the springs (40) to the deformation preventing position. The housings (10, 20) can be separated merely by pulling the slider (41) backward.

14 Claims, 13 Drawing Sheets

CONNECTOR AND A CONNECTOR ASSEMBLY

BACKGROUND OF THE INVENTION

1. Field of the Invention

The invention relates to a connector with a partial connection preventing function.

2. Description of the Related Art

U.S. Pat. No. 6,241,542 and FIGS. 14 and 15 herein show a connector used in an airbag circuit of an automotive vehicle and configured to prevent partial connection. The connector, as shown in FIGS. 14 and 15, has male and female housings 1 and 2. The male housing 1 has a lock arm 3 that deforms resiliently while moving onto a lock 4 of the female housing 2 as the housings 1, 2 are connected. A slider 5 is assembled with the male housing 1 and is held in a forward position by the deformed lock arm 3. A spring 6 is provided in the slider 5 and is compressed by a rib 7 of the female housing 2 to create a biasing force for separating the housings 1, 2. The biasing force of the spring 6 is released and separates the housings 1, 2 if the connecting operation is interrupted prematurely. This prevents the housings 1, 2 from being left partly connected.

The lock arm 3 is restored resiliently and engages the lock 4 when the two connectors 1, 2 are connected properly. Simultaneously, the lock arm 3 is disengaged from the slider 5, and the biasing force of the spring 6 is released to move the slider 5 backward. The slider 5 has a restricting portion 8 that enters a deformation space above the lock arm 3 to prevent the lock arm 3 from being deformed. In this way, the housings 1, 2 are held firmly in a properly connected state, and the connection reliability of the airbag circuit is improved.

The two housings 1, 2 can be separated for maintenance by moving the slider 5 forward to retract the restricting portion 8 from the lock arm 3. The lock arm 3 then is deformed and disengaged from the lock 4, and the male housing 1 is pulled backward. Thus, the operator must successively push the slider 5 forward and pull the male housing 1 backward to separate the housings 1, 2. This need to move the male housing 1 and the slider 5 in completely opposite directions is awkward and inefficient.

The present invention was developed in view of the above problem and an object thereof is to improve operational efficiency during separation.

SUMMARY OF THE INVENTION

The invention relates to a connector that is connectable with a mating connector. The connector has a resilient lock arm and the mating connector has a lock. The lock arm contacts the lock as the connectors are being connected. As a result, the lock arm moves onto the lock and deforms into a deformation permitting space. The lock arm returns resiliently to engage the lock when the connectors are connected properly.

The connector also includes a slider that can move between a deformation preventing position and a deformation permitting position. The slider is in the deformation space and hence prevents deformation of the lock arm when the slider is in the deformation preventing position. However, the lock arm is permitted to deform when the slider is in the deformation permitting position. At least one biasing member is disposed to accumulate a biasing force for separating the connectors as the slider is moved from the deformation preventing position toward the deformation permitting position.

The slider has a resilient member that is deformable in a direction that intersects the connecting directions. Additionally, the mating connector has a pushing portion that pushes the resilient member as the connectors are being connected. The pushing force on the resilient member moves the slider toward the deformation permitting position and hence compresses the biasing member. The connector further comprises a disengagement guide for deforming the resilient member and disengaging the pushing member from the pushing portion of the mating connector as the connectors are connected properly. Thus, the biasing force accumulated in the biasing member is released to move the slider to the deformation preventing position.

The connecting operation could be interrupted halfway. In this situation, the biasing force accumulated in the biasing member is released and the resilient member pushes the pushing portion of the mating connector to forcibly separate the two connectors. This prevents the two connectors from being left partly connected.

The lock arm returns to engage the lock when the two connectors are connected properly. Additionally, the resilient member is deformed resiliently by the disengagement guide and disengages from the pushing portion of the mating connector. Thus, the biasing force of the biasing member moves the slider to the deformation preventing position. As a result, the slider prevents the lock arm from deforming and the two connectors are held firmly in a properly connected state.

The slider preferably is movable substantially along connecting directions of the two connectors between the deformation preventing position and the deformation-permitting portion.

The biasing member preferably is between the slider and a receiving portion in the connector.

The resilient member preferably is metallic. Thus, a danger of a plastic deformation of the resilient member is reduced.

The pushing portion may be a front surface of the mating connector.

The connectors preferably can be separated by moving the slider from the deformation preventing position to the deformation permitting position and then pulling the connector back from the mating connector with sufficient force to deform the lock arm.

The invention also is directed to connector assembly comprising the above-described connector and the mating connector.

The slider is operated in the same direction as the connector is separated from the mating connector. Thus, separation efficiency is good.

The resilient member is pushed by the front surface of the mating connector to simplify the construction of the mating connector. Thus, the resilient member is left resiliently deformed when the two connectors are connected properly. However, the resilient member preferably is metallic, and therefore is less likely to undergo a plastic deformation as compared to a case where the resilient member is made of resin.

The lock preferably is shaped to semi-lock the lock arm.

These and other features of the invention will become more apparent upon reading the following detailed description of preferred embodiments and accompanying drawings. It should be understood that even though embodiments are described separately, single features may be combined to additional embodiments.

DETAILED DESCRIPTION OF THE PREFERRED EMBODIMENTS

A connector for an airbag circuit of an automotive vehicle is shown in FIGS. 1 to 13. The connector includes a male housing 10 to be connected directly with a piece of equipment and a female housing 20 provided at ends of unillustrated wires. The male and female housings 10, 20 are connectable with each other along a connecting direction CD. In the following description, engaging sides of the two housings 10, 20 are referred to as the front and reference is made to all the figures excluding FIGS. 2, 5 and 7 concerning the vertical direction.

Figure 9A:
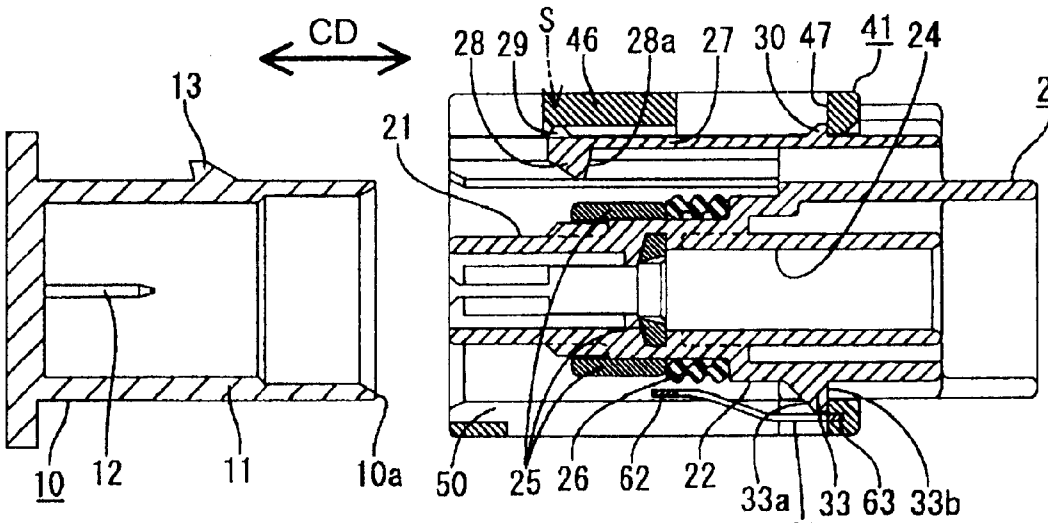
FIGS. 9(A) and 9(B) are sections taken respectively along 9A—9A and 9B—9B of FIG. 6, and showing a state before two housings are connected.
Figure 9B:
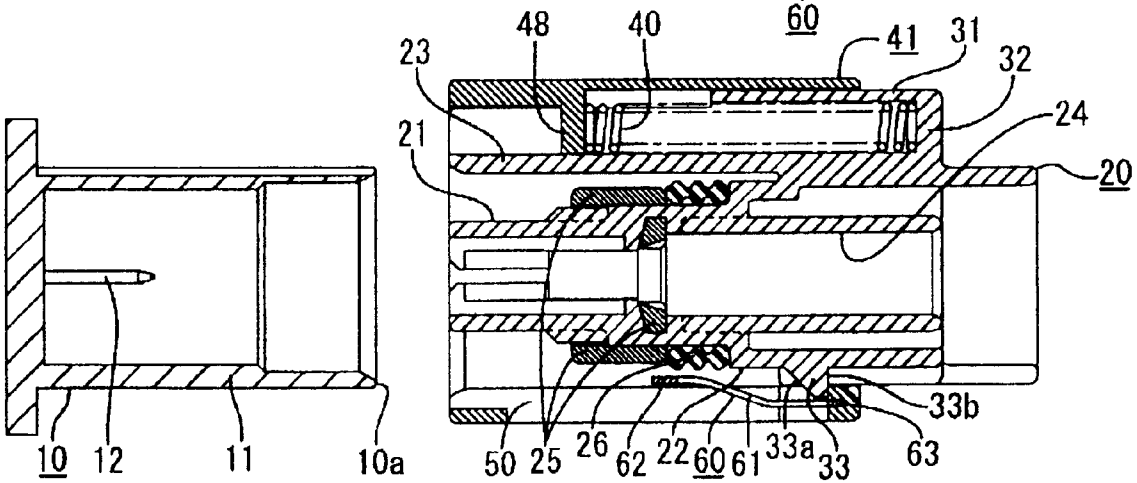

The male housing 10 is made e.g. of a synthetic resin and, as shown in FIGS. 9(A) and 9(B), has a substantially tubular receptacle 11 that projects forward. Tab-shaped male terminals 12 project from the back wall of the male housing 10 and are surrounded by the receptacle 11. A lock 13 projects up substantially at the widthwise center of the upper surface of the receptacle 11. The front end surface of the lock 13 is sloped up and to the back.

Figure 1:
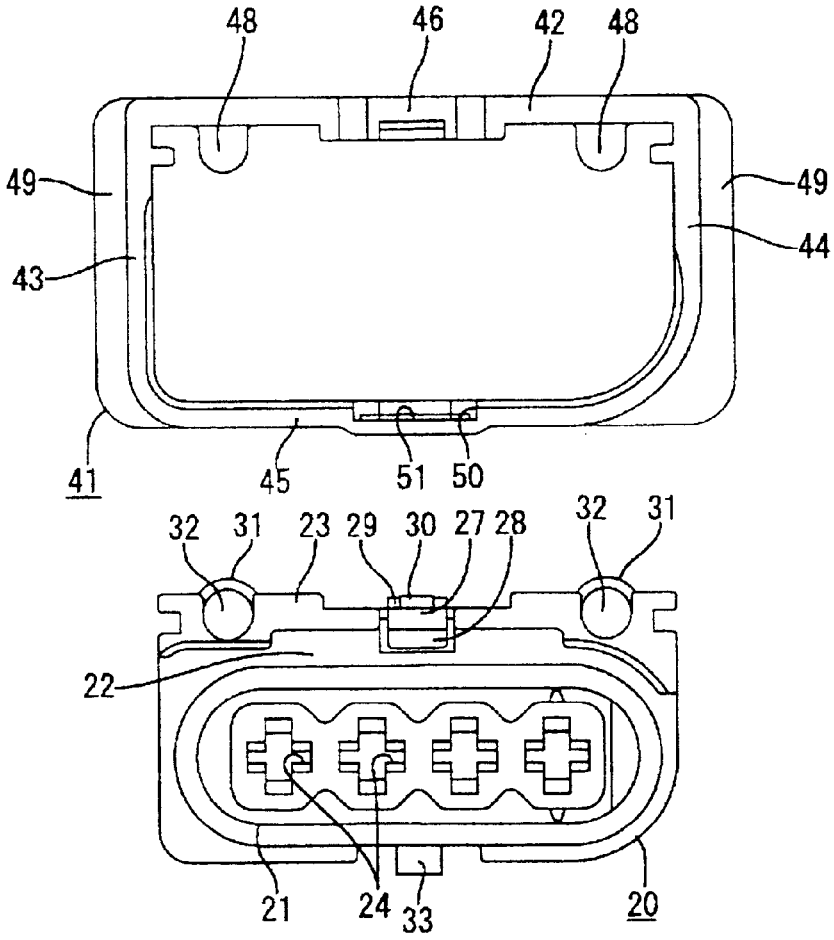
FIG. 1 is a front view of a female housing and a slider according to one embodiment of the invention.

The female housing 20 is made e.g. of a synthetic resin and, as shown in FIGS. 1 and 9, has a terminal-accommodating portion 21 for accommodating female terminal fittings (not shown) that are connected with wires. A fitting groove 22 is formed substantially around the front half of the terminal-accommodating portion 21 and receives the receptacle 11 of the male housing 10. The female housing 20 also includes an upper wall 23 that is spaced from the terminal-accommodating portion 21 by the upper part of the fitting groove 22.

Figure 3:
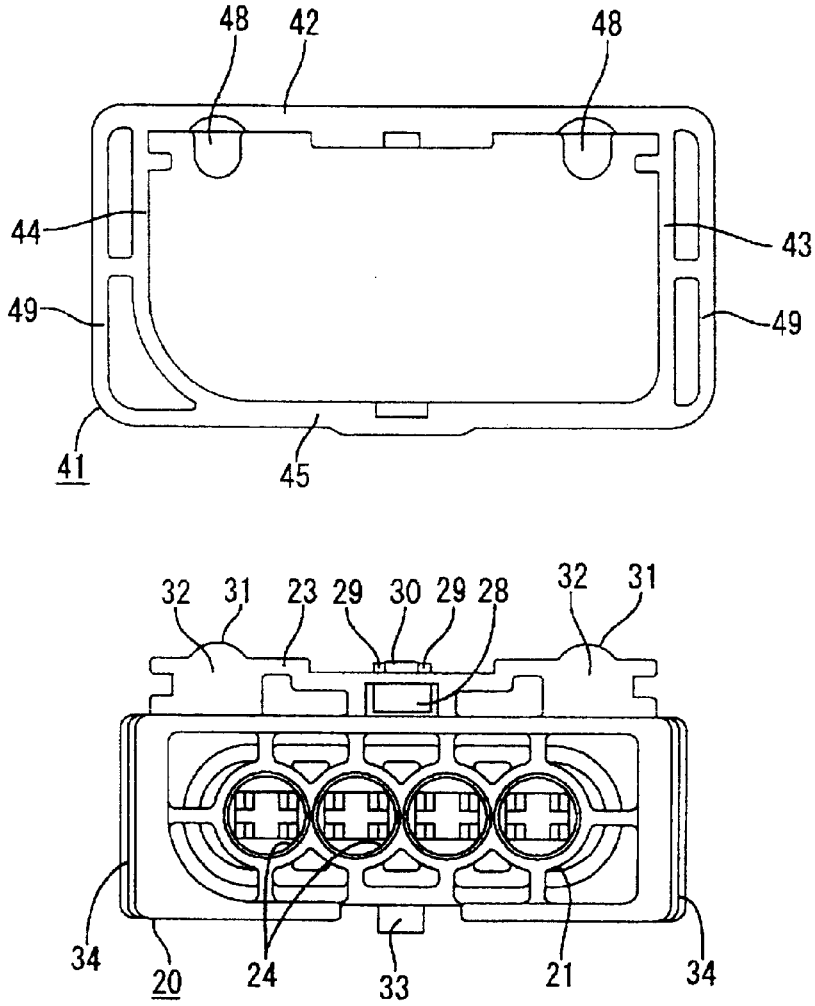
FIG. 3 is a rear view of the female housing and the slider.

Cavities 24 are formed substantially side by side in the terminal accommodating portion 21, as shown in FIGS. 3 and 9, and the female terminal fittings are insertable the cavities 24 from behind. A retainer 25 is mounted sideways into the terminal accommodating portion 21 and enters the cavities 24 for engaging and locking the female terminal fittings. A seal ring 26 is fit on the outer peripheral surface of the terminal-accommodating portion 21. The seal ring 26 is squeezed between the outer peripheral surface of the terminal-accommodating portion 21 and the inner peripheral surface of the receptacle 11 that has been fit into the fitting groove 22. Thus, the seal ring 26 provides a watertight seal between the two housings 10, 20. The retainer 25 is in front of the seal ring 26, and hence prevents the seal ring 26 from coming out.

Figure 2:
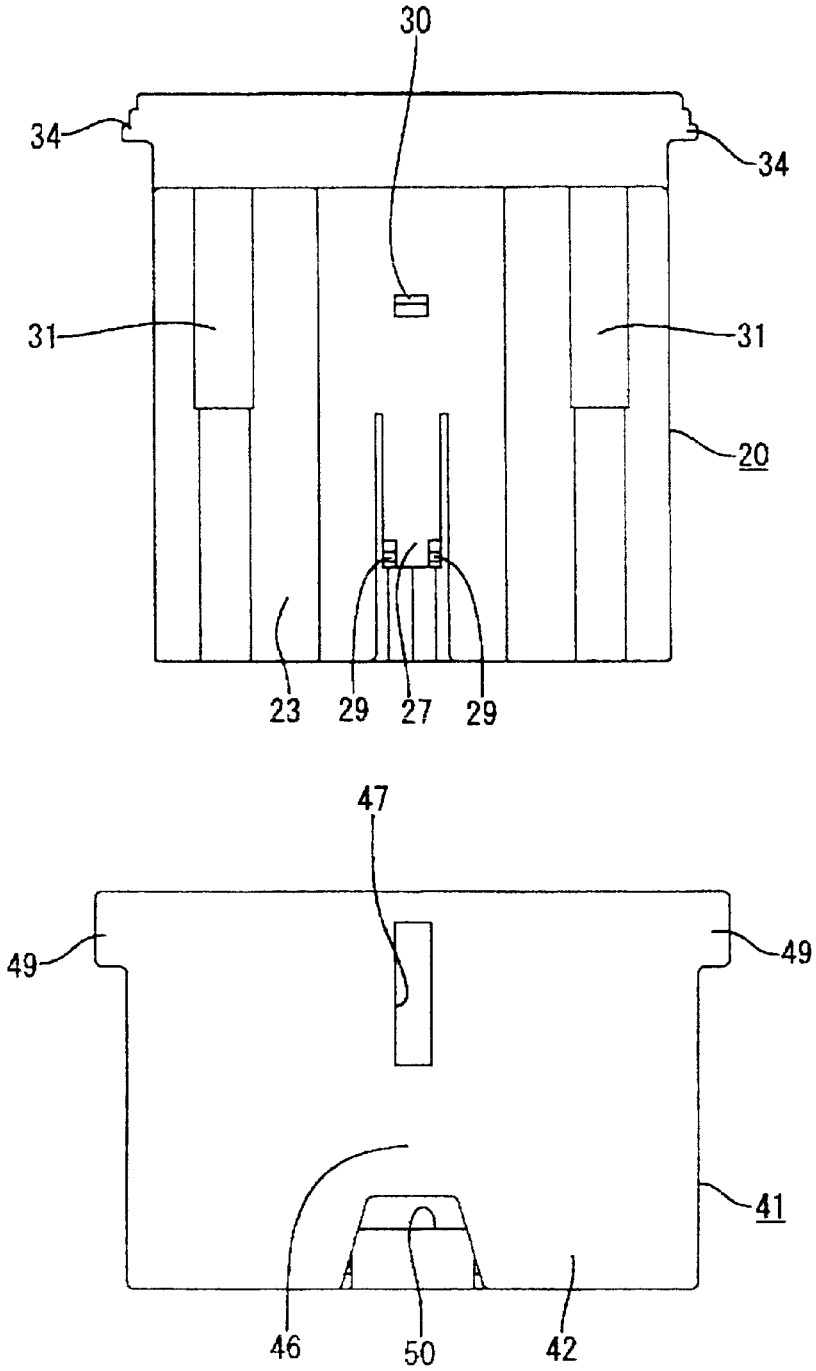
FIG. 2 is a plan view of the female housing and the slider.

A lock arm 27 is cantilevered at substantially the widthwise center of the upper wall 23 by forming two slits symmetrically on the upper wall 23 and cutting off a front end between the slits, as shown in FIGS. 2 and 9. A hook 28 projects from the lower surface of the front end of the lock arm 27 and can move onto the lock 13 as the two housings 10, 20 are connected. The lock arm 27 deforms resiliently at the back ends of the slits as the hook 28 moves onto the lock 13, and hence the lock arm 27 enters the deformation space S above the upper wall 23. The lock arm 27 returns resiliently when the two housings 10, 20 are connected properly so that a rear surface 28*a* of the hook 28 engages the rear surface of the lock 13 (see FIG. 12). The rear surface 28*a* of the hook 28 slopes up and to the back away from the lock 13. Thus, the lock arm 27 is guided by the rear surface 28*a* of the hook 28 and deforms out of engagement with the lock 13 if an attempt is made to separate the two housings 10, 20 with a specified operation force or larger. Two projections 29 are provided at the front end of the upper surface of the lock arm 27, and a front-stop 30 is provided rearward of the lock arm 27. Two spring cavities 31 are provided in the upper wall 23 at the left and right sides of the lock arm 27 in FIG. 2. Each spring cavity 31 is a forwardly open container that extends along forward and backward directions, and has substantially the same length as the terminal-accommodating portion 21. A spring receiving wall 32 is defined at the rear of each spring cavity 31. The front half of the upper wall of the spring accommodating portion 31 is cut away.

A disengagement guide 33 projects down behind the fitting groove 22 at substantially the widthwise center of the bottom surface of the female housing 20, as shown in FIGS. 1, 2 and 9. A front end surface 33*a* of the disengagement guide 33 slopes down to the back. Two connection grips 34 project sideways from opposite outer side surfaces of the rear end of the female housing 20, and can be gripped by an operator to connect the housings 10, 20.

Compression coil springs 40 are disposed in the spring cavities 31 so that the rear ends of the springs 40 engage the spring receiving portions 32.

The connector further includes a slider 41 made e.g. from a synthetic resin and formed substantially in the shape of a rectangular frame, as shown in FIGS. 1 and 9. The slider 41 has opposite front and rear ends defining a length for the slider 41 that is less than the length of the terminal-accommodating portion 21. The female housing 20 is telescoped through the slider 41 for forward and backward movement substantially parallel to the connecting directions CD. More specifically, the slider 41 has an upper wall 42, sidewalls 43, 44 and a bottom wall 45. The upper wall 42 of the slider 41 is above the upper wall 23 of the female housing 20. The sidewalls 43, 44 and the bottom wall 45 of the slider 41 substantially surround the fitting groove 22 together with the upper wall 23.

A substantially widthwise center of the upper wall 42 of the slider 41 has its front end cut off in substantially the same manner as the upper wall 23, as shown in FIGS. 1, 2 and 9. A deformation-preventing panel 46 is defined behind the cut-off portion of the upper wall 42 and is engageable with the projections 29 when the deformation-preventing panel 46 is above the deformation space S for the lock arm 27 to prevent the lock arm 27 from being deformed. A substantially rectangular hole 47 is formed behind the deformation-preventing panel 46 of the upper wall 42, and the rear surface of the front-stop 30 engages the rear surface of the rectangular hole 47. Two spring holders 48 project from the upper wall 42 of the slider 41 at opposite sides of the deformation-preventing panel 46 for holding the front ends of the compression coil springs 40 in the spring cavities 31. Two separation grips 49 project laterally from the outer side surfaces of the rear ends of the opposite side walls 43, 44 of the slider 41 and can be gripped by an operator to separate the housings 10, 20. The separation grips 49 project more outward on the slider 41 than the connection grips 34 (see FIG. 7). Further, the sidewall 44 at the right side of FIG. 1 has a retainer insertion hole through which the retainer 25 is insertable (see FIG. 5).

Figure 4:
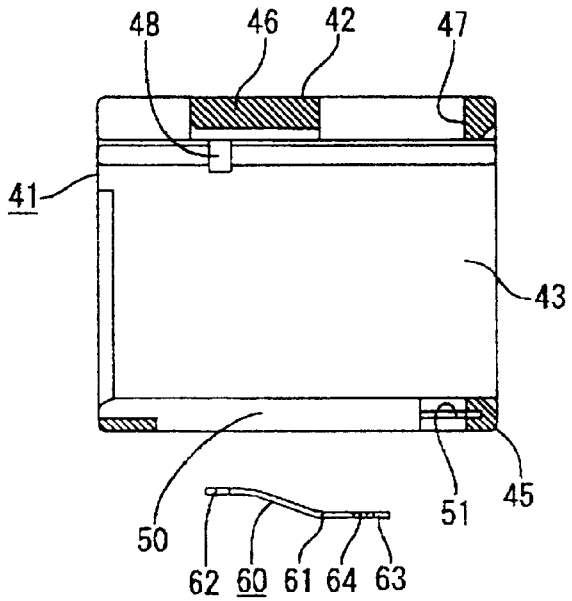
FIG. 4 is a side view in section of a resilient piece and the slider.
Figure 5:
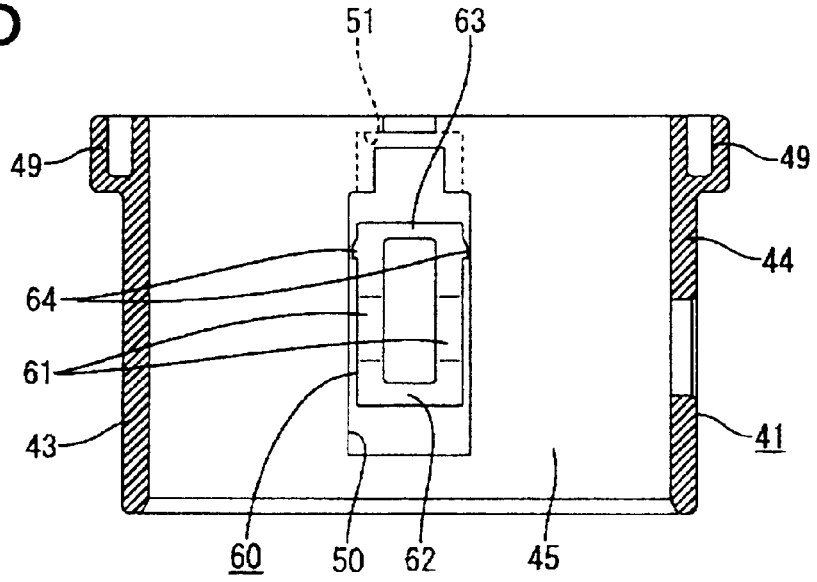
FIG. 5 is a plan view in section of the resilient piece and the slider.

A opening 50 is formed substantially at the widthwise center of the bottom wall 45 of the slider 41 at a location spaced from the front and rear ends, as shown in FIGS. 4 and 5. The opening 50 is narrowed over a specified length at the rear side. The narrower area of the opening 50 is slightly wider than the disengagement guide 33. Press-in grooves 51 are formed in the opposite side surfaces and the rear end surface of the narrower area of the opening 50.

Figure 7:
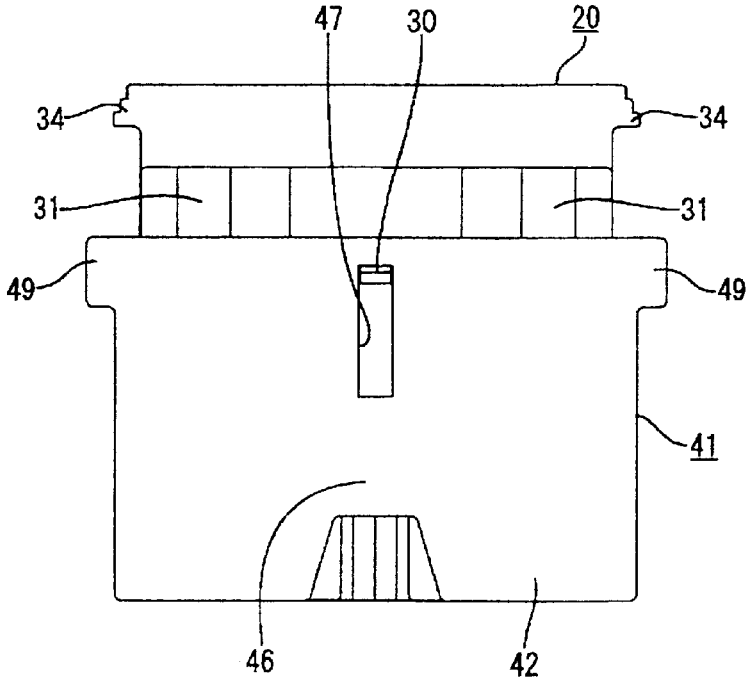
FIG. 7 is a plan view showing the state where the slider and the like are assembled with the female housing.
Figure 11A:
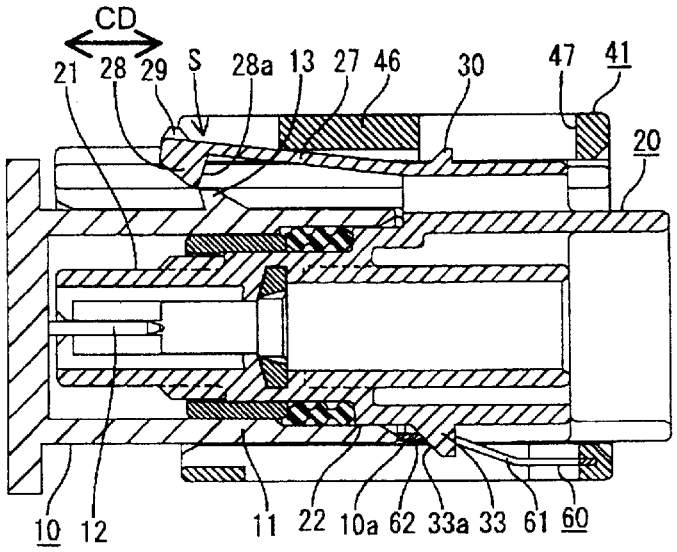
FIGS. 11(A) and 11(B) are sections similar to FIGS. 9(A) and 9(B), but showing a state where the lock arm is deformed resiliently while the two housings are being connected.

The slider 41 is assembled with the female housing 20 by inserting the compression coil springs 40 into the respective spring cavities 31 and inserting the spring holders 48 into the cut-off portions of the upper walls of the spring cavities 31. The front-stop 30 enters the rectangular hole 47 when the slider 41 reaches a specified depth and engages the rear surface of the rectangular hole 47. Additionally, the disengagement guide 33 engages the rear end surface of the opening 50, as shown in FIGS. 7 and 9. Thus, the slider 41 is stopped at its front-limit position. At this time, the slider 41 has its front end surface substantially aligned with the front end of the female housing 20 and the deformation-preventing panel 46 is in the deformation space S to prevent deformation of the lock arm 27. Additionally, the compression coil springs 40 are compressed slightly. An assembled position of the slider 41 in this state is referred to as a deformation preventing position. The slider 41 is movable back from the deformation preventing position to a deformation permitting position where the deformation-preventing panel 46 is retracted from the deformation space S. The lock arm 27 can be deformed, as shown in FIG. 11A, when the slider is in the deformation permitting position. The coil springs 40 are compressed between the backward-moving spring holders 48 and the fixed spring receiving walls 32 when the slider 41 is moved back. Thus, the compressed coil springs 40 accumulate biasing forces to separate the two housings 10, 20 (see FIG. 11(B)).

The connector also includes a resilient piece 60 formed by bending a metallic plate that has been stamped out into a frame shape, as shown in FIGS. 4 and 5. Specifically, the resilient piece 60 has two sides 61 that extend forward and backward. A front 62 and a rear 63 extend between the front and rear ends of the sides 61. The sides 61 are bent in the middle so that the front ends of the sides 61 slope up and to the front. The resilient piece 60 is held on the slider 41 by pressing the rear ends of the sides 61 and the rear 63 into the press-in grooves 51 of the slider 41. Fastening projections 64 are provided on the side surfaces of the rear ends of the sides 61 for biting into the inner side surfaces of the press-grooves 51 to fasten the resilient piece 60 firmly. The spacing between the sides 61 is slightly larger than the width of the disengagement guide 33 (see FIG. 8).

Figure 6:
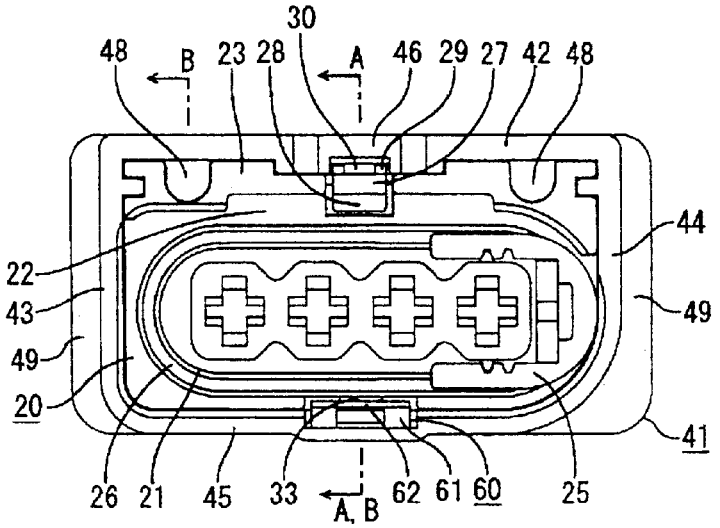
FIG. 6 is a front view showing a state where the slider and the like are assembled with the female housing.
Figure 8:
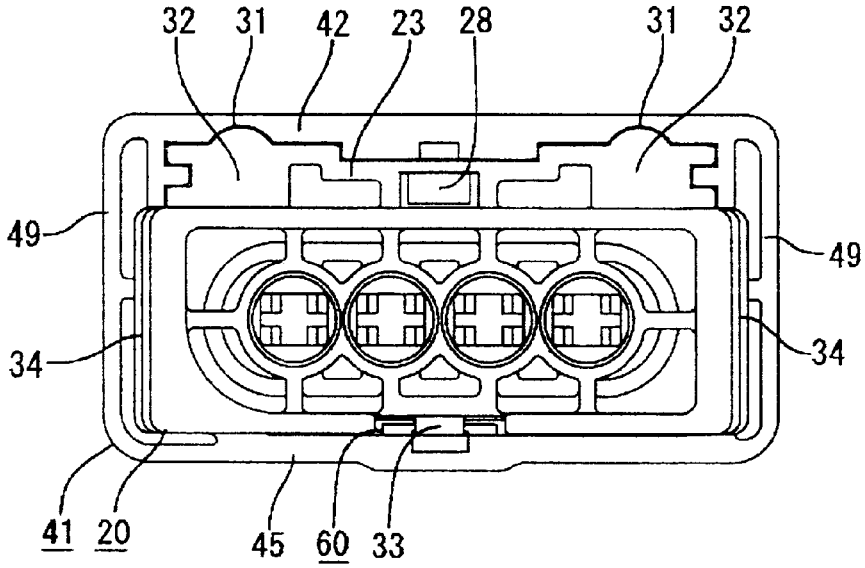
FIG. 8 is a rear view showing the state where the slider and the like are assembled with the female housing.

The slider 41, with the resilient piece 60 mounted therein, is assembled with the female housing 20 so that the disengagement guide 33 enters between the sides 61 of the resilient piece 60 and so that the front 62 of the resilient piece 60 is in the fitting groove 22, as shown in FIGS. 6, 8 and 9.

Figure 10A:
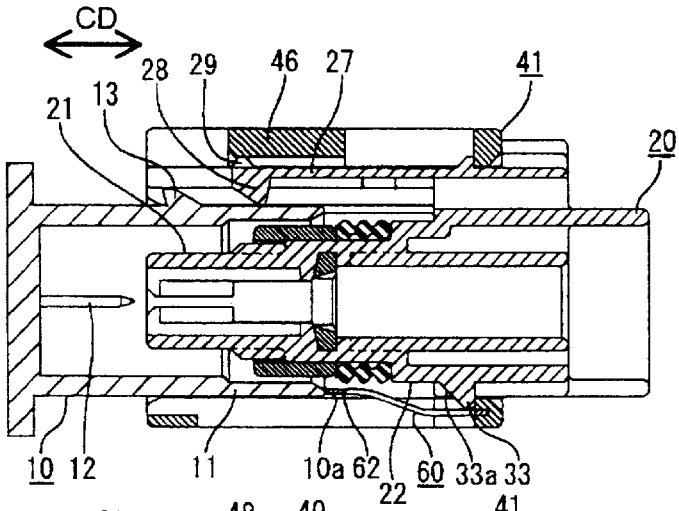
FIGS. 10(A) and 10(B) are sections similar to FIGS. 9(A) and 9(B), but showing a state where a front surface of a receptacle contacts the resilient piece while the two housings are being connected.
Figure 10B:
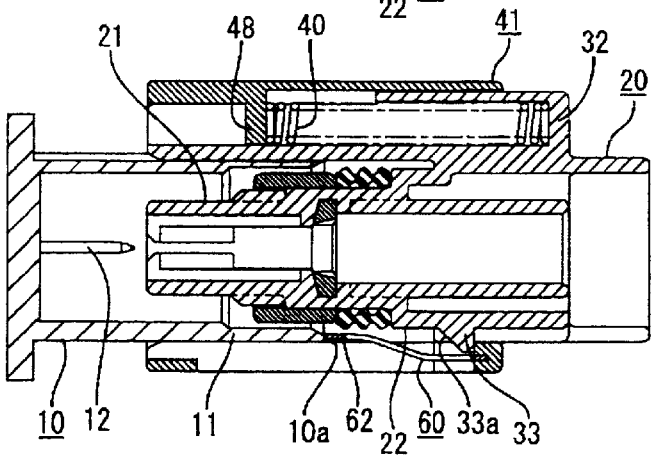
Figure 11B:
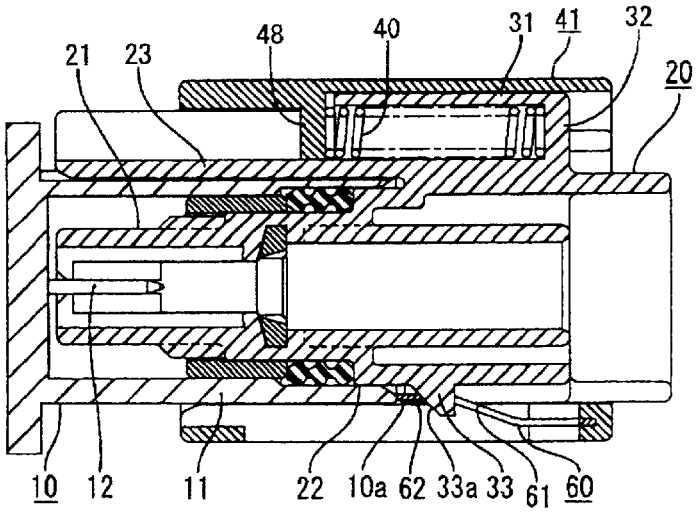
Figure 12A:
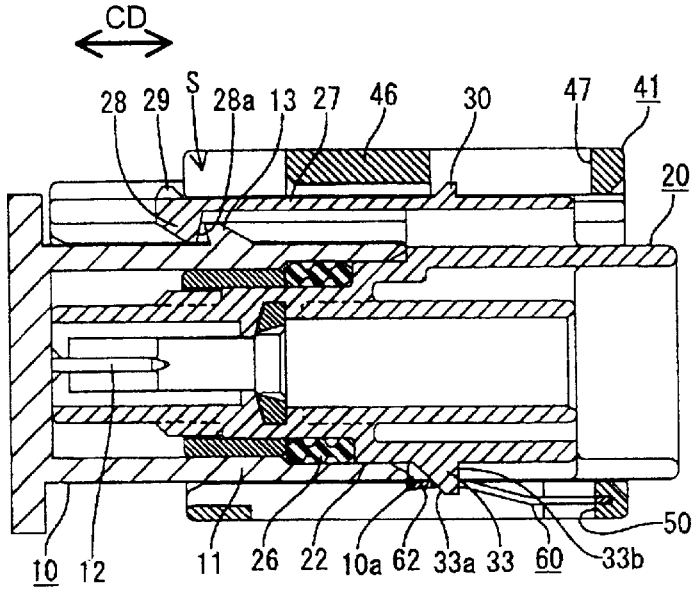
FIGS. 12(A) and 12(B) are sections similar to FIGS. 9(A) and 9(B), but showing a state where the two housings are connected properly connected and the resilient piece is deformed resiliently.
Figure 12B:
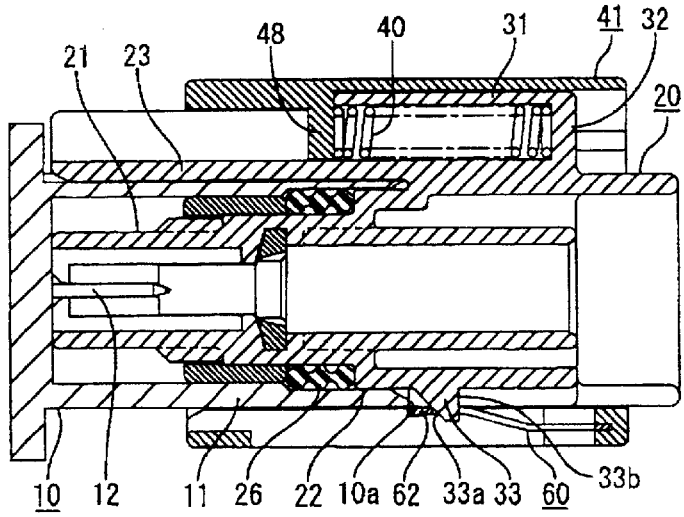

The receptacle 11 of the male housing 10 is fit into the fitting groove 22 of the female housing 20. As a result, the front surface 10*a* of the bottom portion of the receptacle 11 contacts the front 62 of the resilient piece 60, as shown in FIG. 10. The front 62 of the resilient piece 60 is pushed by the front end surface 10*a* of the receptacle 11 as the connection of the two connectors 10, 20 proceeds, and the slider 41 is moved back from the deformation preventing position toward the deformation permitting position. The compression coil springs 40 have their rear ends received by the spring receiving walls 32. However, the front ends of the springs 40 are pushed back by the spring holding portions 48 as the slider 41 is moved back. As a result, the springs 40 are compressed and accumulate biasing forces to separate the two housings 10, 20 (see FIG. 11(B)). The hook 28 of lock arm 27 moves onto the lock 13 as the slider 41 is moved backward to the deformation permitting position. Consequently, the lock arm 27 deforms into the deformation space S as shown in FIG. 11. In this process, the disengagement guide 33 enters between the opposite sides 61 of the resilient piece 60. As the connection further proceeds, the front end surface 33*a* of the disengagement guide 33 slides in contact with the rear surface of the front 62 of the resilient piece 60. Therefore, the resilient piece 60 deforms and the front 62 displaces down to reduce the area of engagement with the front surface 10*a* of the receptacle 11.

The connecting operation could be interrupted despite the fact that the two connectors are left partly connected. In this situation, the biasing forces accumulated in the compressed coil springs 40 are released, and the forwardly biased resilient piece 60 of the slider 41 pushes the front end surface 10*a* of the receptacle 11 to separate the two housings 10, 20. As a result, the two housings 10, 20 are not left partly connected.

The hook 28 moves over the lock 13 when the housings 10, 20 are connected to the proper depth and the lock arm 27 resiliently returns so that the front end surface 28*a* of the hook 28 engages the rear end surface of the lock 13. Substantially simultaneously, the resilient piece 60 is deformed by the front end surface 33*a* of the disengagement guide 33 to a position where the front 62 disengages completely from the front surface 10*a* of the receptacle 11.

Figure 13A:
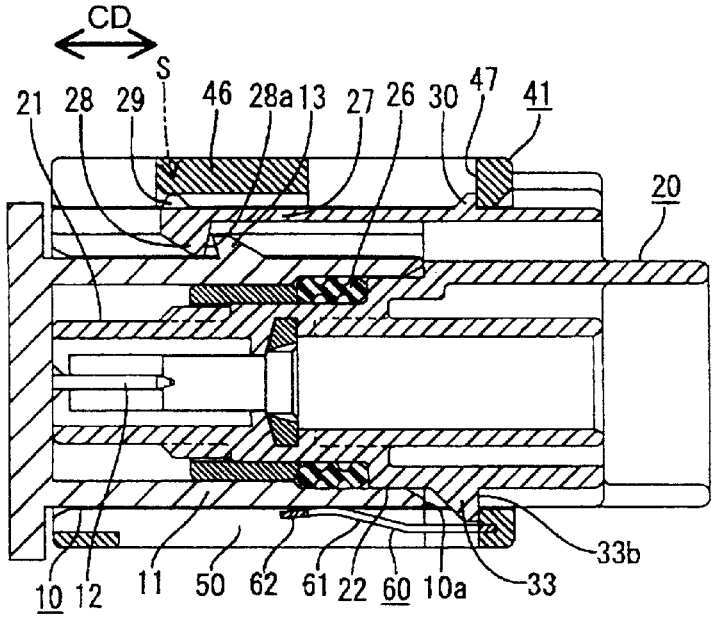
FIGS. 13(A) and 13(B) are sections similar to FIGS. 9(A) and 9(B), but showing a state reached by moving the slider forward to a deformation preventing position.
Figure 13B:
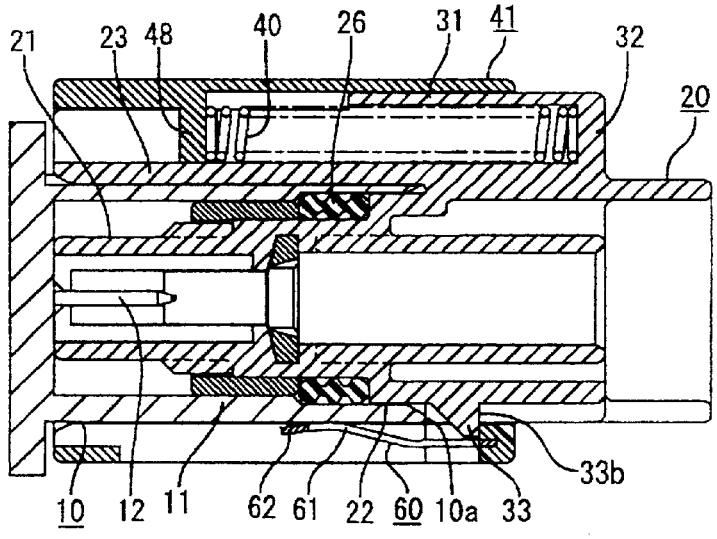
Figure 14A:
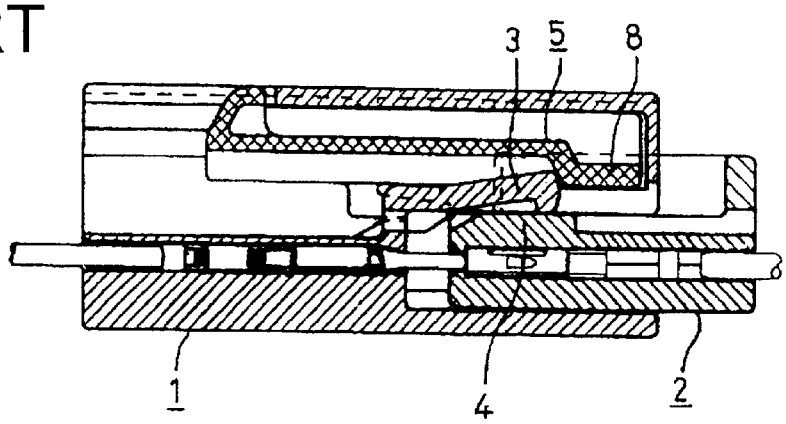
FIG. 14(A) PRIOR ART
FIGS. 14(A) and 14(B) are a section along a lock arm and a section along a spring showing a partly connected state of a prior art connector, respectively.
Figure 14B:
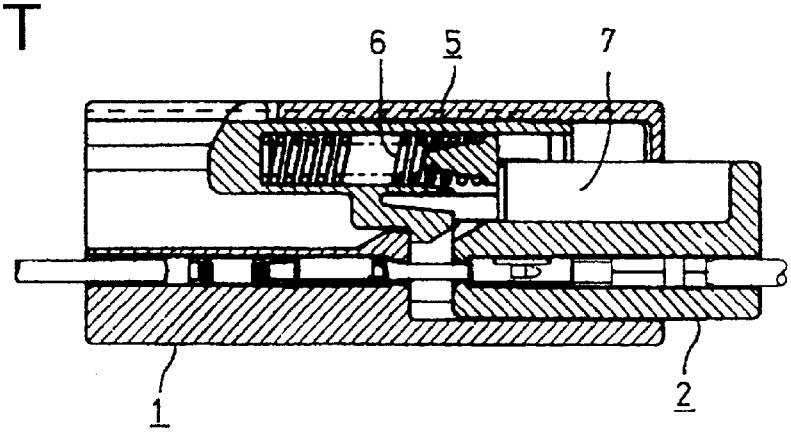
FIG. 14(B) PRIOR ART
Figure 15A:
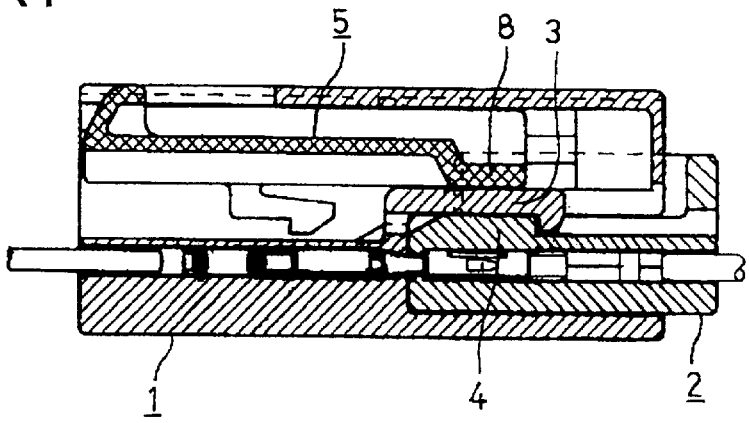
FIG. 15(A) PRIOR ART
FIGS. 15(A) and 15(B) are a section along the lock arm and a section along the spring showing a properly connected state of the prior art connector, respectively.
Figure 15B:
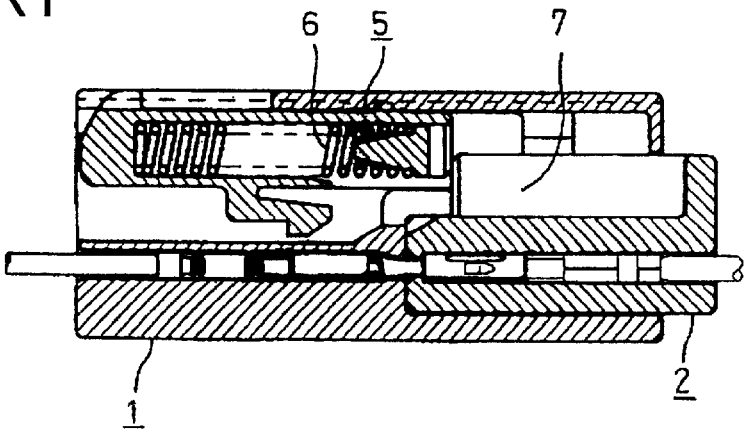
FIG. 15(B) PRIOR ART

This causes the biasing forces accumulated thus far in the compression coil springs 40 to be released, and propels the slider 4- forward from the deformation permitting position to the deformation preventing position. The deformation preventing panel 46 enters the deformation space S when the slider 41 reaches the deformation-preventing position and contacts the projection 29 from above, as shown in FIG. 13. Thus, the lock arm 27 cannot be deformed, and the two housings 10, 20 are held firmly in a properly connected state. At this time, the resilient piece 60 contacts the bottom surface of the receptacle 11 and is deformed. There is a danger of plastically deforming a resilient piece that is left in the above-described state. However, the resilient piece 60 is metallic, and is less likely to deform plastically as compared, for example, to a resilient piece made of a synthetic resin. In the properly connected state of the housings 10, 20, the seal ring 26 closely contacts the inner peripheral surface of the receptacle 11 and the outer peripheral surface of the terminal accommodating portion 21 to provide a watertight seal between the two housings 10, 20.

The two housings 10, 20 may be separated for maintenance or other reason. In such a case, the slider 41 is pulled back by gripping the separation grips 49 (see FIG. 7). The backward movement of the slider 41 from the deformation preventing position compresses the compression coil springs 40. The slider 41 then is pulled further with a specified operation force or larger after reaching the deformation permitting position shown in FIG. 12. Thus, the lock arm 27 is guided by the rear end surface 28*a* of the hook 28 and deforms until the hook 28 is disengaged from the lock 13 The female housing 20 then is moved back and separated from the male housing 10 as shown in FIG. 11. In this way, an operation of moving the slider 41 backward to the deformation permitting position, an operation of resiliently deforming the lock arm 27 and an operation of separating the two housings 10, 20 can be performed at once by one operation of pulling the slider 41.

As described above, separation operability is good because the slider 41 is moved in the same direction that the female housing 20 is moved to separate the two housings 10, 20. Further, the rear end surface 28*a* of the hook 28 is slanted to effect semi-locking with the lock 13. Thus, the locked state of the two housings 10, 20 can be released automatically by pulling the slider 41, which results in better separation efficiency.

The resilient piece 60 is left resiliently deformed with the two housings 10, 20 properly connected. However, the resilient piece 60 is formed from metal and is unlikely to undergo a plastic deformation. The resilient piece 60 could be made completely free from problems of plastic deformation by making a few design changes. For example, a pushing portion for pushing the resilient piece could project out from the bottom surface of the male housing, and the resilient piece could be at a position corresponding to this pushing portion so as to return resiliently while letting the pushing portion escape when the two housings 10, 20 are connected properly. However, such an arrangement requires the male housing to have a pushing portion, and hence the construction of the male housing would be more complex. The preferred embodiment desirably has a very simple male housing 10 and, accordingly, the resilient piece 60 is left resiliently deformed with the two housings 10, 20 properly connected. However, the metallic resilient piece 60 avoids problems of plastic deformation.

The invention is not limited to the above described and illustrated embodiment. For example, the following embodiments are embraced by the technical scope of the invention. Beside the following embodiments, various changes can be made without departing from the scope of the present invention.

Although the resilient piece is pressed and held in the slider in the foregoing embodiment, it may be, for example, inserted during resin-molding of the slider.

Although the resilient piece has a frame shape in the foregoing embodiment, it may be, for example, in the form of a single plate and a projection engageable with the disengagement guiding portion may be provided at one side edge thereof. The resilient piece may take any other desired shape.

The slider and the compression coil springs are mounted in the female housing and the resilient piece of the slider is pushed by the male housing in the foregoing embodiment. However, male and female housings having reverse constructions are also embraced by the present invention.

Although the compression coil springs are shown as the biasing members in the foregoing embodiment, leaf springs or the like may be used as such.

Although the connector has a seal ring in the foregoing embodiment, the present invention is also applicable to nonwatertight connectors.

The resilient piece contacts a front portion of the male connector housing in the foregoing embodiment. However, the resilient piece may contact another pushing portion provided thereon.

The slider is moved substantially along the connecting direction in the foregoing embodiment. However, the slider may be moved along a different direction, such as a direction slightly inclined to the connecting direction.

What is claimed is:

1. A connector (20) connectable with a mating connector (10) having a locking portion (13), wherein the connector (20) comprises:

a lock arm (27) resiliently deformable while moving onto a lock (13) in the process of connecting the two connectors (20, 10) and returning to engage the lock (13) when the two connector housings (20, 10) are connected properly;

a slider (41) movable between a deformation preventing position where the slider (41) enters a deformation space (S) for the lock arm (27) to prevent resilient deformation of the lock arm (27) and a deformation permitting position where the slider (41) permits the resilient deformation of the lock arm (27); and at least one biasing member (40) which can be compressed while accumulating a biasing force to separate the two connector housings (20, 10) as the slider (41) is moved from the deformation preventing position toward the deformation permitting position;

wherein:

the slider (41) comprises a resilient member (60) which is resiliently deformable in a direction intersecting the connecting directions (CD) and can be pushed by a pushing portion (10*a*) of the mating connector (10) to move the slider (41) from the deformation preventing position to the deformation permitting position in the process of connecting the two connector housings (20, 10), the connector (20) further comprises a disengagement guide (33) for resiliently deforming the resilient member (60) while disengaging it from the pushing portion (10*a*) of the mating connector (10) as the two connector housings (20, 10) are connected properly, thereby releasing a biasing force accumulated in the biasing member (40) to move the slider (41) toward the deformation preventing position.

2. The connector of claim 1, wherein the deformation permitting position is reached by moving the slider (41) backward from the deformation space to permit the resilient deformation of the lock arm (27).

3. The connector of claim 1, wherein the biasing member (40) is between the slider (41) and a receiving portion (32) in the connector (20).

4. The connector of claim 1, wherein the resilient member (60) is metallic.

5. A connector assembly according to claim 1, wherein the locking portion (13) is shaped to semi-lock the lock arm (27).

6. The connector (20) of claim 1, wherein the slider (41) is movable substantially along connecting directions (CD) of the two connectors (20, 10) between the deformation preventing position and the deformation permitting position.

7. The connector of claim 6, wherein the resilient member (60) can be pushed by a pushing portion (10*a*) of the mating connector (10) to move the slider (41) from the deformation preventing position to the deformation permitting position in the process of connecting the two connector housings (20, 10).

8. The connector of claim 7, wherein the pushing portion (10*a*) comprises a front surface (10*a*) of the mating connector (10).

9. A connector comprising:

a housing (20) having opposite front and rear ends and a connecting direction (CD) extending between the ends, a lock arm (27) and a disengagement guide (33) being formed on the housing (20), the lock arm (27) being configured for resilient deformation into a deformation space (S), the lock arm (27) having a hook (28) with a partial locking surface aligned at an acute angle to the connecting direction (CD);

a slider (41) movable along the housing (20) between a deformation preventing position where the slider (41) enters the deformation space (S) for the lock arm (27) to prevent resilient deformation of the lock arm (27) and a deformation permitting position where the slider (41) is spaced from the deformation space (S) to permit resilient deformation of the lock arm (27);

a metallic resilient member (60) mounted to the slider (41) and configured for contacting the disengagement guide (33) when the slider (41) moves to the deformation permitting position and being resiliently deformable in a direction intersecting the connecting direction (CD) in response to contact with the disengagement guide (33); and at least one biasing member (40) between the slider (41) and the housing (20) for biasing the slider (41) toward the deformation preventing position.

10. A connector assembly comprising:

a first housing (10) having a front surface (10*a*) and a lock (11);

a second housing (20) connectable with the first housing (10) along a connecting direction (CD), a lock arm (27) and a disengagement guide (33) being formed on the housing (20), the lock arm (27) being configured for resilient deformation into a deformation space (S) and having a hook (28) configured for partial locking with the lock (11);

a slider (41) movable along the housing (20) between a deformation preventing position where the slider (41) enters the deformation space (S) for the lock arm (27) to prevent resilient deformation of the lock arm (27) and a deformation permitting position where the slider (41) is spaced from the deformation space (S) to permit resilient deformation of the lock arm (27);

at least one spring (40) between the slider (41) and the housing (20) for biasing the slider (41) toward the deformation preventing position;

a metallic resilient member (60) mounted to the slider (41) and configured for contacting the front surface (10*a*) of the first housing (10) during connection of the housings (10, 20) for moving the slider (41) against the spring (40) and toward the deformation permitting position, the resilient member (60) further being configured for being deformed by the disengagement guide (33) out of contact with the front surface (10*a*) of the first housing (10) when the housings (10, 20) are connected properly so that the biasing member (40) propels the slider (41) to the deformation preventing position.

11. The connector of claim 10, wherein the slider (41) is movable substantially along the connecting directions (CD) between the deformation preventing position and the deformation permitting position.

12. The connector assembly of claim 11, wherein the slider (41) is movable substantially along the connecting direction (CD) of the housings (20, 10).

13. The connector assembly of claim 12, wherein the resilient member (60) is substantially a rectangular frame with resiliently deflectable sides (61) spaced apart sufficiently to receive the disengagement guide (33) therebetween.

14. The connector assembly of claim 13, wherein the resilient member further includes a rear end (63) secured in the slider (60) and a front end (62) disposed for engage the disengagement guide (33).

* * * * *